US012465160B2

(12) United States Patent
Hsieh et al.

(10) Patent No.: US 12,465,160 B2
(45) **Date of Patent: *Nov. 11, 2025**

(54) BEVERAGE CONTAINER ASSEMBLY AND COVER COMPONENT THEREOF

(71) Applicant: TIMAS TITAN CO., LTD., Taipei (TW)

(72) Inventors: Han-Chun Hsieh, Taipei (TW); Han-Chieh Hsieh, Taipei (TW)

(73) Assignee: TIMAS TITAN CO., LTD., Taipei (TW)

( * ) Notice: Subject to any disclaimer, the term of this patent is extended or adjusted under 35 U.S.C. 154(b) by 0 days.

This patent is subject to a terminal disclaimer.

(21) Appl. No.: 18/739,251

(22) Filed: Jun. 10, 2024

(65) Prior Publication Data

US 2024/0324800 A1 Oct. 3, 2024

Related U.S. Application Data

(63) Continuation of application No. 17/896,091, filed on Aug. 26, 2022, now Pat. No. 12,035,826.

(30) Foreign Application Priority Data

May 9, 2022 (TW) ..... 111117347

(51) Int. Cl.
*A47G 19/22* (2006.01)
*B65D 43/02* (2006.01)
(Continued)

(52) U.S. Cl.
CPC ..... *A47G 19/2272* (2013.01); *A47G 19/2222* (2013.01); *A47G 19/2288* (2013.01);
(Continued)

(58) Field of Classification Search
CPC ..... A47G 19/2272; A47G 19/2222; A47G 19/2266; A47G 21/18; B65D 47/0857;
(Continued)

(56) References Cited

U.S. PATENT DOCUMENTS 3,138,280 A * 6/1964 Shafer ..... B65D 81/3818 220/574.3
6,763,964 B1 * 7/2004 Hurlbut ..... A47G 19/2272 222/481.5
(Continued)

FOREIGN PATENT DOCUMENTS

CN 103813963 A 5/2014
CN 105314234 A 2/2016
(Continued)

*Primary Examiner* — Robert Poon
(74) *Attorney, Agent, or Firm* — Li & Cai Intellectual Property Office

(57) ABSTRACT

A beverage container assembly and a cover component thereof are provided. The beverage container assembly includes a beverage container, the cover component, and a straw. The cover component includes a first cover and a second cover pivotally connected thereto. The first cover has a top portion that includes an opening portion and a pivot portion, and has a sleeve portion that is connected to a lower end of the top portion. The second cover has a connecting arm and a main body portion that has a straw accommodating portion. A pivot end of the connecting arm has two first pivots that protrude outward and an expansion joint located at a center of the pivot end, so that a distance between terminal ends of the two first pivots can be shortened for easy engagement with or separation from two first pivot holes on the pivot portion.

12 Claims, 12 Drawing Sheets

(51) Int. Cl.

| | |
|---|---|
| ***B65D 47/08*** | (2006.01) |
| ***B65D 51/24*** | (2006.01) |
| ***B65D 81/38*** | (2006.01) |

(52) U.S. Cl.
CPC ..... *B65D 43/0229* (2013.01); *B65D 47/0857* (2013.01); *B65D 51/242* (2013.01); *B65D 81/3874* (2013.01); *B65D 2231/022* (2013.01)

(58) Field of Classification Search
CPC .... B65D 47/06; B65D 2231/022; B65D 7/22; B65D 81/027
USPC ..... 220/592.17, 592.16, 233, 254.1, 254.3, 220/254.8, 254.4, 259.1
See application file for complete search history.

(56) References Cited

U.S. PATENT DOCUMENTS

| | | | | |
|---|---|---|---|---|
| 8,672,164 | B2 * | 3/2014 | Honeyghan ..... | B65D 47/0895 220/849 |
| 8,978,923 | B2 * | 3/2015 | George ..... | B65D 43/0225 215/311 |
| 10,531,753 | B1 | 1/2020 | Cleveland et al. | |
| 2012/0018431 | A1 * | 1/2012 | Wu ..... | B65D 47/242 220/259.4 |
| 2012/0312832 | A1 | 12/2012 | Lane | |
| 2013/0214006 | A1 | 8/2013 | Roth et al. | |
| 2013/0240543 | A1 | 9/2013 | Jordan | |
| 2014/0069918 | A1 | 3/2014 | Meyers et al. | |
| 2016/0296051 | A1 | 10/2016 | Lane et al. | |
| 2020/0010250 | A1 | 1/2020 | Herling et al. | |
| 2020/0317409 | A1 | 10/2020 | Yu | |

FOREIGN PATENT DOCUMENTS

| | | | |
|---|---|---|---|
| KR | 20000063677 | A | 11/2000 |
| KR | 200488738 | Y1 | 3/2019 |
| TW | M587158 | U | 12/2019 |

* cited by examiner

BEVERAGE CONTAINER ASSEMBLY AND COVER COMPONENT THEREOF

CROSS-REFERENCE TO RELATED PATENT APPLICATION

This application is a continuation application of the U.S. application Ser. No. 17/896,091, filed on Aug. 26, 2022 and entitled "BEVERAGE CONTAINER ASSEMBLY AND COVER COMPONENT THEREOF", now pending, the entire content of the above identified application is incorporated herein by reference.

Some references, which may include patents, patent applications and various publications, may be cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference was individually incorporated by reference.

FIELD OF THE DISCLOSURE

The present disclosure relates to a beverage container assembly and a cover component thereof, and more particularly to a beverage container assembly and a cover component thereof that allow a user to carry along beverages or drinking water.

BACKGROUND OF THE DISCLOSURE

With the recent rise of environmental awareness, people are aiming to reduce a usage amount of disposable plastic containers. As such, carrying a thermos or a tumbler on one's person for storage of drinking water or beverages has become a trend in the modern-day society. Furthermore, in order to reduce a usage amount of plastic straws, people are also using reusable straws that are made of metal or glass for drinking beverages.

If a length of a straw that is used with a conventional thermos is too short, the entire straw may sink after being placed inside a container, so that it is necessary for a user to pull the straw out of an opening of the container with their fingers in order to use the straw. In addition, the straw can easily become unclean after being grasped by the user.

However, if the length of the straw is configured to be greater than a height of the opening of the container, an upper end of the straw will protrude above the opening of the container when the straw is inserted into the container. As a result, when a cover of the container is used for covering, the cover may structurally interfere with the upper end of the straw. In order to cover the opening of the container with the cover of the container, the straw needs to be taken out of the container for separate storage. Not only does such a process cause inconvenience in use, but the straw may easily come in contact with pollutants, thereby adversely affecting hygiene.

In view of the above, there are a number of inconveniences when using the existing container with the straw. Therefore, how to overcome the above-mentioned deficiencies through an improvement in structural design has become one of the important issues to be solved in the related art.

SUMMARY OF THE DISCLOSURE

In response to the above-referenced technical inadequacies, the present disclosure provides a beverage container assembly and a cover component thereof.

In one aspect, the present disclosure provides a beverage container assembly, which includes a beverage container, a straw, and a cover component. The beverage container has a container body, an accommodating space is formed inside the container body, an upper end of the container body has an opening end, and an inner side of the opening end has an inner threaded portion. The straw is capable of being received in the accommodating space of the container body, the straw is a reusable straw that is unbendable, the straw has a hollow tube, and a through hole is formed at a center of the hollow tube and has a diameter ranging between 6 mm and 15 mm. The cover component is disposed at the upper end of the beverage container. The cover component includes a first cover and a second cover. The first cover has a top portion and a sleeve portion that is linkable with the opening end. The top portion has a circular shape, the top portion defines a top surface and a bottom surface, the top portion includes an opening portion and a pivot portion that is protrudingly disposed on the top surface of the top portion, and the opening portion is a round hole that is disposed near an inner side of an outer periphery of the top portion. The sleeve portion is connected to the bottom surface of the top portion, and an outer side wall of the sleeve portion has an outer threaded portion that cooperates with the inner threaded portion. The second cover has a main body portion and a connecting arm that is connected to the main body portion. A bottom end of the main body portion has a sealed portion that cooperates with the opening portion, an inner side of the main body portion has a straw accommodating portion that is upwardly recessed from a bottom surface of the main body portion, a width of the straw accommodating portion is greater than a diameter of the straw, and a pivot end that is pivotally connected to the pivot portion is formed at an end of the connecting arm relative to the main body portion. The second cover is swingable around the pivot end, so that the main body portion of the second cover covers the first cover or departs from the first cover. When the second cover covers the first cover, the straw accommodating portion is located above the opening portion. A length of the straw is configured to be greater than a length between a bottom portion of the accommodating space of the container body and the top surface of the top portion, so that an upper end of the straw protrudes above the opening portion when the straw is placed inside the beverage container. The pivot portion is disposed at a side of the top portion relative to the opening portion, a center of the pivot portion has a longitudinal slot, a center of the longitudinal slot is aligned with a center of the opening portion, the longitudinal slot has two slot side walls that are parallel to each other, a distance between the two slot side walls is defined as a first distance, and the two slot side walls each has a first pivot hole that corresponds to the other. The connecting arm of the second cover is made of a plastic material having elasticity, two first pivots that protrude outward are respectively disposed at two sides of the pivot end of the connecting arm, and an expansion joint is formed at a center of the pivot end. The two first pivots correspond in position and diameter to the two first pivot holes, and a distance between terminal ends of the two first pivots is greater than the first distance, such that the two first pivots are capable of being fitted into the two first pivot holes. The expansion joint is a groove positioned between the two first pivots, and the groove has an opening that faces toward a terminal end of the pivot end. A width of the pivot end located at the expansion joint is deformably adjustable, so that the distance between the terminal ends of the two first pivots is able to be shortened to be less than the first distance to allow the two first pivots to be fitted into or separated from the two first pivot holes.

Therefore, in the beverage container assembly and the cover component thereof provided by the present disclosure, when the straw having a length greater than a height between the bottom portion of the accommodating space of the container body and the top surface of the first cover is used, the upper end of the straw can be directly exposed above the opening portion. In addition, without removal of the straw, the second cover can cover the first cover, and the upper end of the straw can be accommodated in the straw accommodating portion. Since the second cover can be easily detached from or assembled to the first cover, manufacturers may use second covers of different specifications in cooperation with the same first cover.

These and other aspects of the present disclosure will become apparent from the following description of the embodiment taken in conjunction with the following drawings and their captions, although variations and modifications therein may be affected without departing from the spirit and scope of the novel concepts of the disclosure.

BRIEF DESCRIPTION OF THE DRAWINGS

The described embodiments may be better understood by reference to the following description and the accompanying drawings, in which.

DETAILED DESCRIPTION OF THE EXEMPLARY EMBODIMENTS

Figure 1:
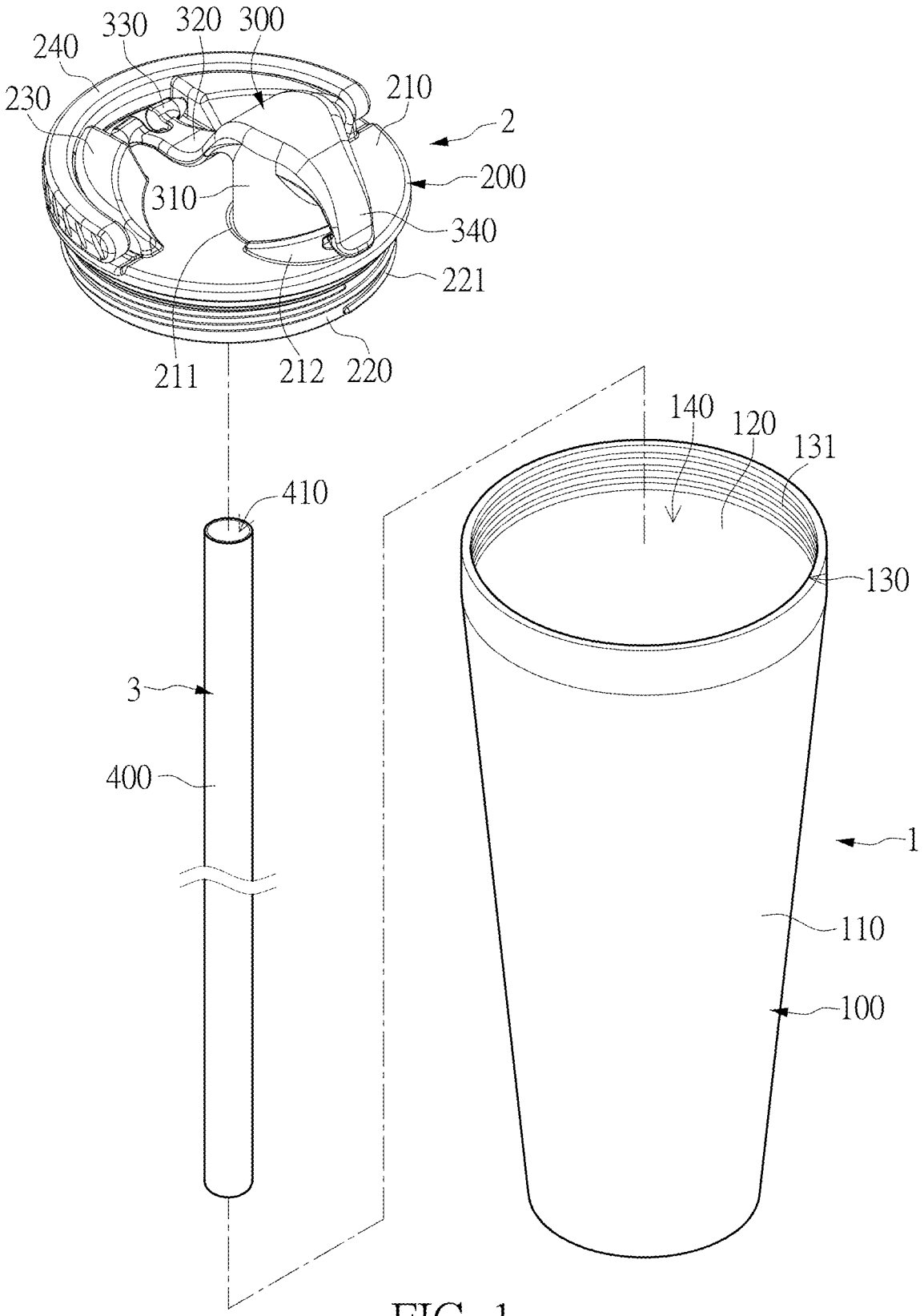
FIG. 1 is a perspective exploded view of a beverage container assembly according to a first embodiment of the present disclosure.
Figure 2:
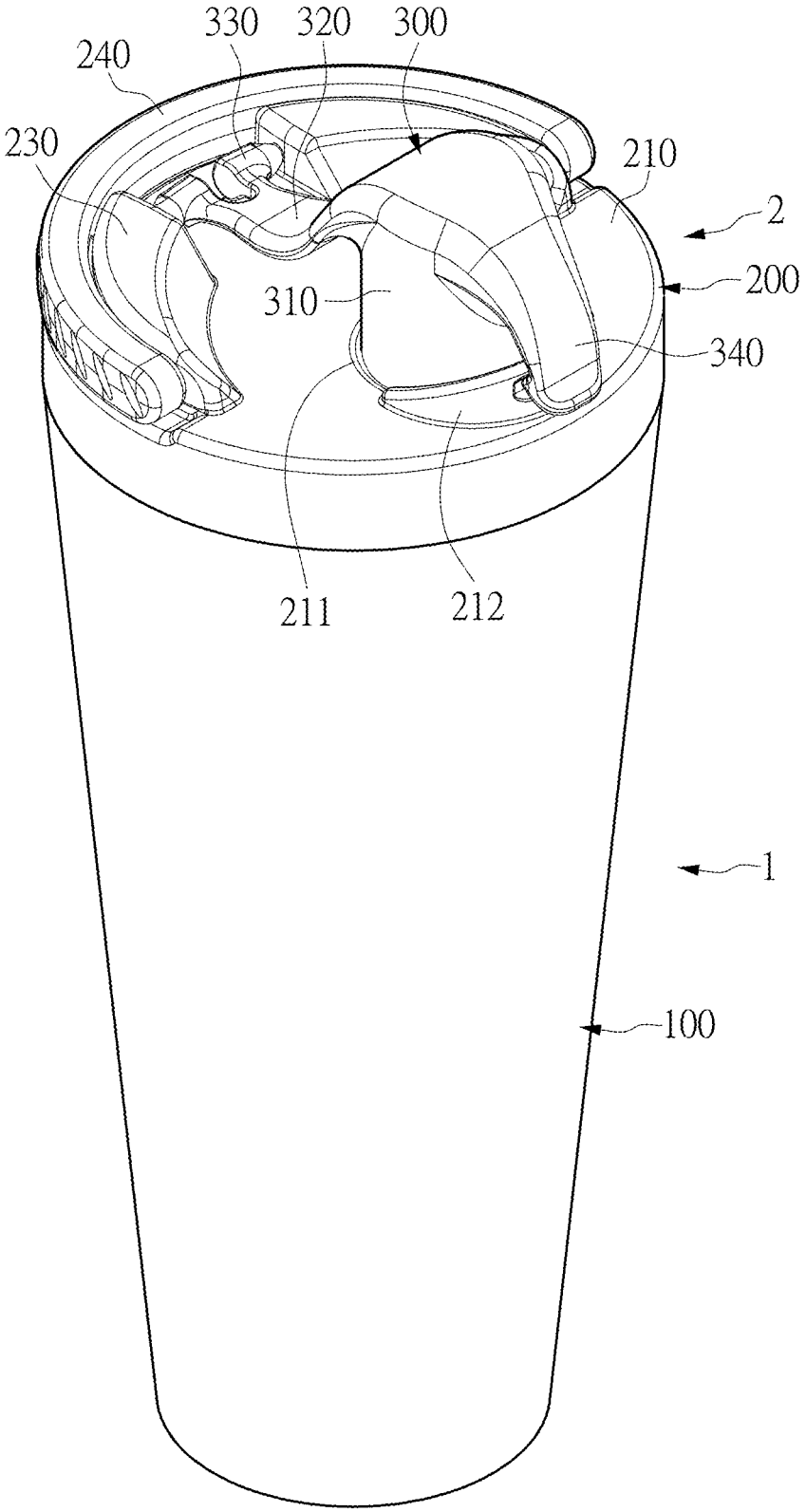
FIG. 2 is a perspective assembled view of the beverage container assembly according to the first embodiment of the present disclosure.

The present disclosure is more particularly described in the following examples that are intended as illustrative only since numerous modifications and variations therein will be apparent to those skilled in the art. Like numbers in the drawings indicate like components throughout the views. As used in the description herein and throughout the claims that follow, unless the context clearly dictates otherwise, the meaning of "a", "an", and "the" includes plural reference, and the meaning of "in" includes "in" and "on". Titles or subtitles can be used herein for the convenience of a reader, which shall have no influence on the scope of the present disclosure.

The terms used herein generally have their ordinary meanings in the art. In the case of conflict, the present document, including any definitions given herein, will prevail. The same thing can be expressed in more than one way. Alternative language and synonyms can be used for any term(s) discussed herein, and no special significance is to be placed upon whether a term is elaborated or discussed herein. A recital of one or more synonyms does not exclude the use of other synonyms. The use of examples anywhere in this specification including examples of any terms is illustrative only, and in no way limits the scope and meaning of the present disclosure or of any exemplified term. Likewise, the present disclosure is not limited to various embodiments given herein. Numbering terms such as "first", "second" or "third" can be used to describe various components, signals or the like, which are for distinguishing one component/signal from another one only, and are not intended to, nor should be construed to impose any substantive limitations on the components, signals or the like.

First Embodiment

Referring to FIG. 1 to FIG. 8, an embodiment of the present disclosure provides a beverage container assembly and a cover component thereof. The beverage container assembly includes a beverage container 1, a cover component 2, and a straw 3. The beverage container 1 has a container body 100, and the container body 100 defines an upper end and a lower end. An accommodating space 140 is formed inside the container body 100, and the accommodating space 140 can be used for containing beverages or drinking water. The upper end of the container body 100 has an opening end 130, and a sealed bottom portion is formed at the lower end of the container body 100. In the present embodiment, the container body 100 has an outer cup body 110 and an inner cup body 120 that are spaced apart from each other. A thermal insulation interlayer 150 is formed between the inner cup body 120 and the outer cup body 110, so that the beverage container 1 can have an improved thermal insulation capacity and achieve a desired heat or cold insulation effect. An inner threaded portion 131 is disposed at an inner side of the opening end 130, and is configured to be fixed with the cover component 2.

Figure 8:
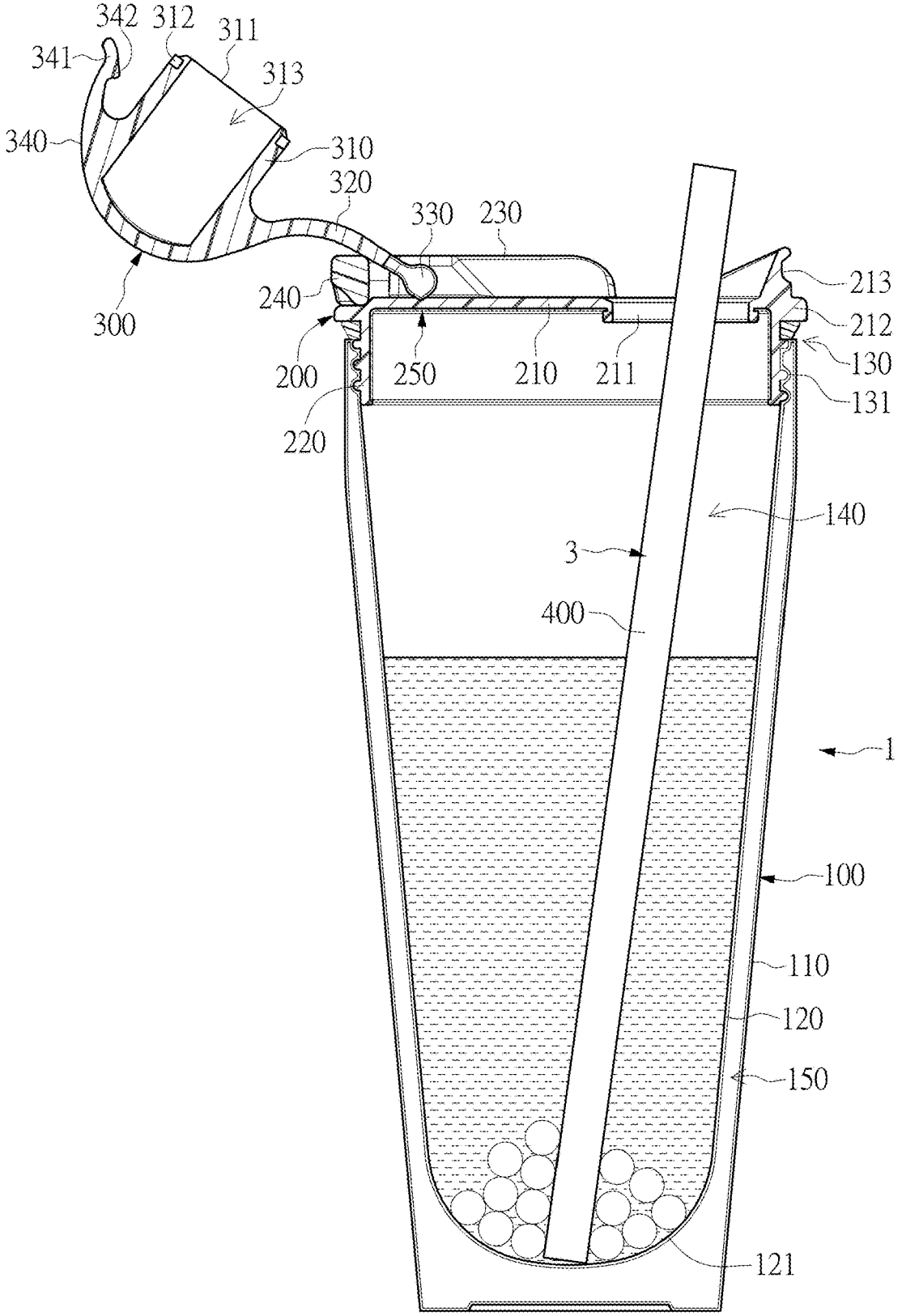
FIG. 8 is a schematic sectional view of the beverage container assembly when the second cover is in an opening state according to the first embodiment of the present disclosure.

It should be noted that in the present embodiment, the inner cup body 120 and the outer cup body 110 of the beverage container 1 can be made of titanium metal plates. Further, an inner cup bottom portion 121 is formed at a bottom of the inner cup body 120, and the inner cup bottom portion 121 is downwardly recessed at a center position thereof. When the beverage contained in the accommodating space 140 includes granular ingredients (e.g., tapioca pearls, coconut jelly, and konjac), the granular ingredients can gather at the center position of the inner cup bottom portion 121 due to gravity (as shown in FIG. 8). In this way, a user can smoothly consume the granular ingredients in the beverage through the straw 3, so as to avoid situations where the granular ingredients cannot be consumed due to being stuck at bottom edges of a beverage container.

Figure 7A:
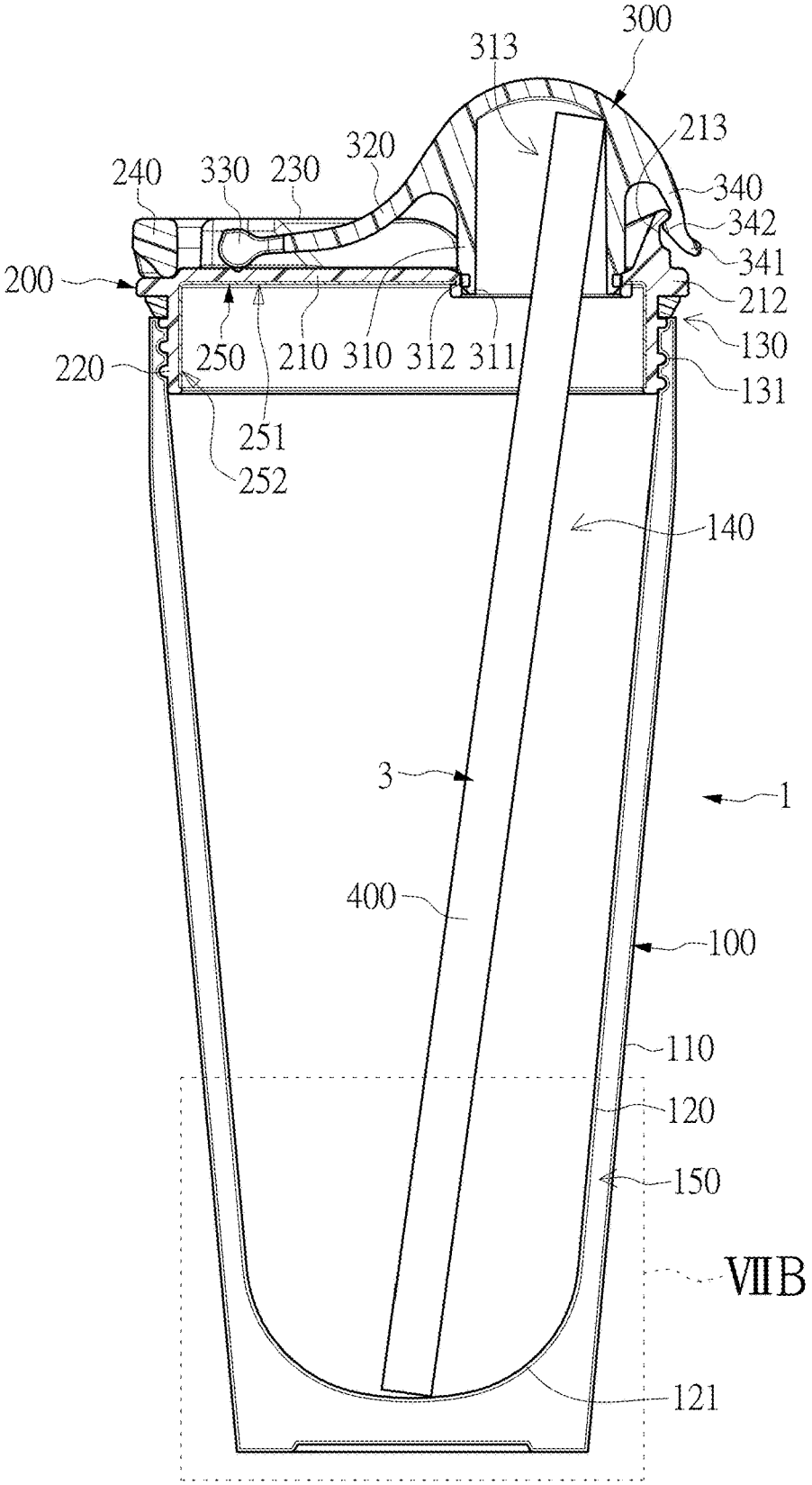
FIG. 7A is a schematic sectional view of the beverage container assembly when a second cover is in a covering state according to the first embodiment of the present disclosure.
Figure 7B:
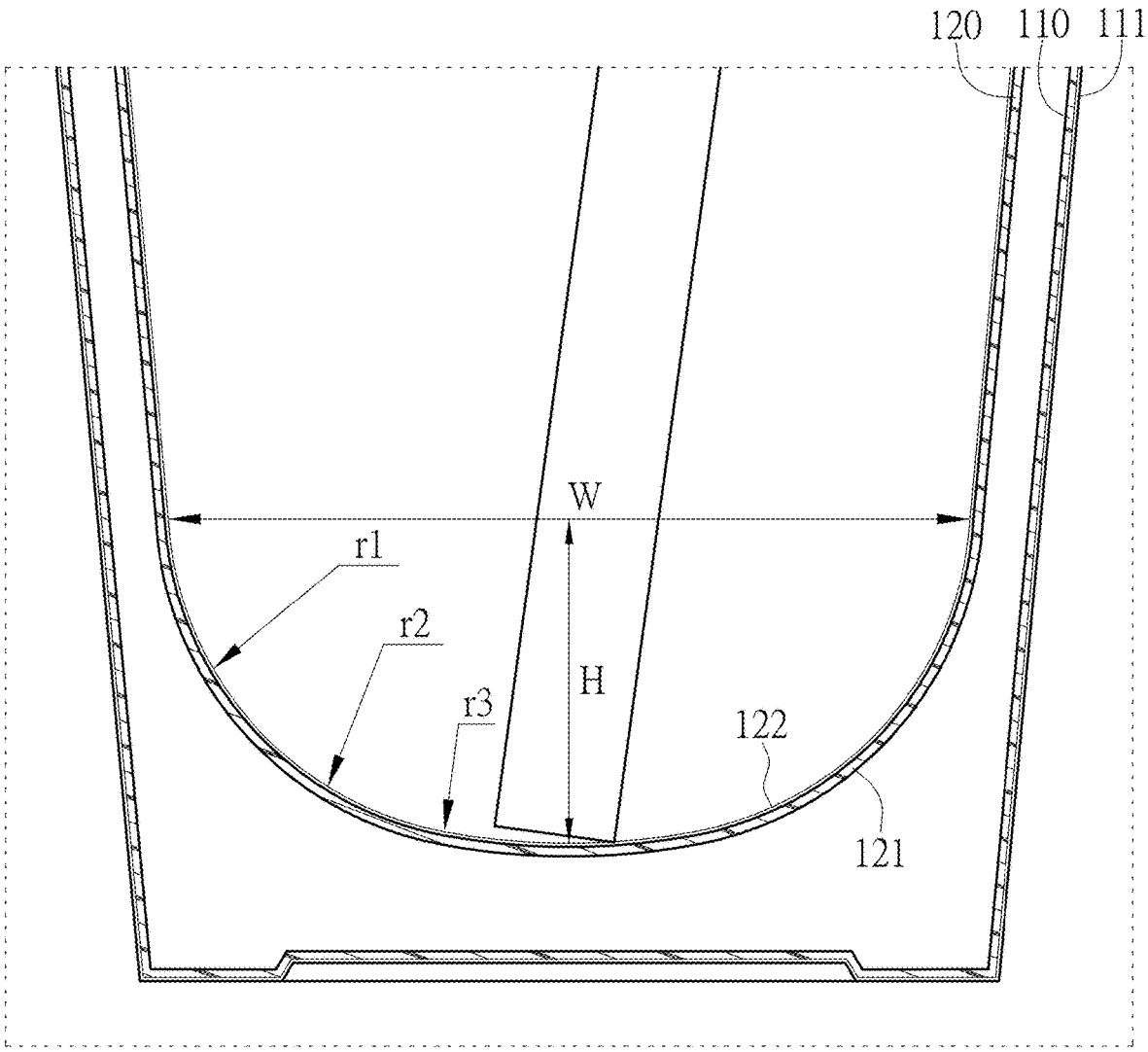
FIG. 7B is a partial enlarged sectional view of part VII B of FIG. 7A.

Referring to FIG. 7B, the outer cup body 110 and the inner cup body 120 of the container body 100 are formed by stamping or drawing of the titanium metal plates. After the outer cup body 110 and the inner cup body 120 are formed, the outer cup body 110 and the inner cup body 120 are soldered together by way of soldering, so as to form the container body 100.

In the present embodiment, the inner cup bottom portion 121 of the inner cup body 120 is integrally formed at the bottom of the inner cup body 120 by way of stamping or drawing. The inner cup bottom portion 121 is formed by connecting a plurality of arc-shaped portions that have different radii of curvature, or have a non-spherical concave shape formed by a freeform surface with continuously changing radii of curvature. For example, as shown in FIG. 7B, radii of curvature r1, r2, r3 at three different positions (from an outer side toward the center position) of the inner cup bottom portion 121 are different from one another, so that the inner cup bottom portion 121 has the non-spherical concave shape.

More specifically, in the present embodiment, the radii of curvature r1, r2, r3 of the inner cup bottom portion 121 (from a position at an outermost side toward the center position thereof) are arranged to gradually increase from outside to inside, such that a part of the inner cup bottom portion 121 that is close to the outer side has a smaller radius of curvature, and a part of the inner cup bottom portion 121 that is close to the center position thereof has a larger radius of curvature. In other words, the radii of curvature r1, r2, r3 has a relationship of $r1<r2<r3$. As such, half a width W of the inner cup bottom portion 121 is greater than a depth H of the inner cup bottom portion 121.

It should be noted that the inner cup bottom portion 121 of the present disclosure is configured in the above-mentioned manner for the reasons given below. Since the inner cup body 120 takes the form of a cylinder having an extremely high aspect ratio, and the titanium metal is a material that is difficult for molding and processing, several stamping or drawing processes need to be carried out before formation of the inner cup body 120 and the inner cup bottom portion 121. In addition, the titanium metal has a shape memory characteristic. If the inner cup bottom portion 121 is designed to have a spherical shape with one single radius of curvature, the inner cup bottom portion 121 is difficult to be formed and is prone to breakage. However, through the above-mentioned configuration, the inner cup bottom portion 121 of the present disclosure can overcome the shape memory characteristic of the titanium metal and can be easily formed. The aspect ratio of the inner cup bottom portion 121 is also reduced, thereby preventing occurrences of breakage during processing.

For the container body 100, an inner oxide layer 122 is formed on an inner side surface of the inner cup body 120, and an outer protective layer 111 is formed on an outer side surface of the outer cup body 110 (as shown in FIG. 7B). In the present disclosure, the inner oxide layer 122 of the inner cup body 120 and the outer protective layer 111 of the outer cup body 110 are oxide films formed through different oxidation processes. In this way, the inner oxide layer 122 and the outer protective layer 111 can have different properties.

More specifically, the inner oxide layer 122 is used for allowing a surface of the inner cup body 120 to have good antibacterial and anti-sticking properties. As such, the inner oxide layer 122 is a titanium oxide thin film in a rutile crystal form that is formed on the surface of the inner cup body 120 through a thermal oxidation process. Due to having a good photocatalytic activity, the inner oxide layer 122 has a good antibacterial property. Further, titanium oxide is a ceramic crystal material. Hence, the inner oxide layer 122 can be formed into a ceramic surface, such that the anti-sticking property of the inner cup body 120 can be improved. Since the inner oxide layer 122 is formed through the thermal oxidation process, the inner oxide layer 122 does not come into contact with an electrolytic solution during a manufacturing process thereof. This prevents the inner oxide layer 122 from being polluted by the electrolytic solution.

The outer protective layer 111 is used for enhancing abrasion resistance of the container body 100 and improving aesthetic appearance. As such, the outer protective layer 111 is a titanium-based compound (e.g., titanium oxide, titanium nitride, or titanium oxynitride) thin film that is formed on the outer side surface of the outer cup body 110 through the thermal oxidation process, an electrochemical process, or a micro-arc oxidation process. The outer protective layer 111 has high hardness and is abrasion resistant, so that the outer cup body 110 can be prevented from being worn down. In addition, the color of the outer protective layer 111 can be changed by adjusting a mixing ratio of working gases and a forming temperature during formation of the outer protective layer 111. Therefore, an outer surface of the outer cup body 110 can have various color changes, and the aesthetic appearance of the outer cup body 110 can be improved.

In the present embodiment, the straw 3 is a reusable straw that is unbendable (e.g., rigid). Preferably, the straw 3 has a hollow tube 400, and the hollow tube 400 is a tube made of plastic, glass, or metal materials, so that the straw 3 has sufficient strength and is not damaged as a result of repeated use. A through hole 410 that extends from an upper end to a lower end is formed at a center of the hollow tube 400 and has a diameter ranging between 6 mm and 15 mm, so as to allow the granular ingredients that have a large diameter to pass through. Accordingly, the straw 3 is suitable for drinking beverages that are added with solid granular ingredients (e.g., tapioca pearls, konjac, and fruit grains).

As shown in FIG. 2 to FIG. 5, the cover component 2 is disposed at the opening end 130 of the beverage container 1. The cover component 2 includes a first cover 200 and a second cover 300 that is detachably disposed on the first cover 200. The first cover 200 has a top portion 210 and a sleeve portion 220. The top portion 210 approximately exhibits the shape of a circular plate. The top portion 210 defines a top surface and a bottom surface. The top portion 210 is configured to include an opening portion 211 and a pivot portion 230. The opening portion 211 is positioned near an inner side of an outer periphery of the top portion 210, and is a round hole that extends from the top surface to the bottom surface of the top portion 210. A diameter of the opening portion 211 is configured to be greater than an outer diameter of the straw 3, so that the straw 3 can pass through the opening portion 211. It should be noted that in the present embedment, a length of the straw 3 is configured to be greater than a length between a bottom portion of the accommodating space 140 of the container body 100 and the top surface of the top portion 210 of the first cover 200, so that an upper end of the straw 3 protrudes above the opening portion 211 when the straw 3 is placed inside the beverage container 1 through the opening portion 211.

Figure 4:
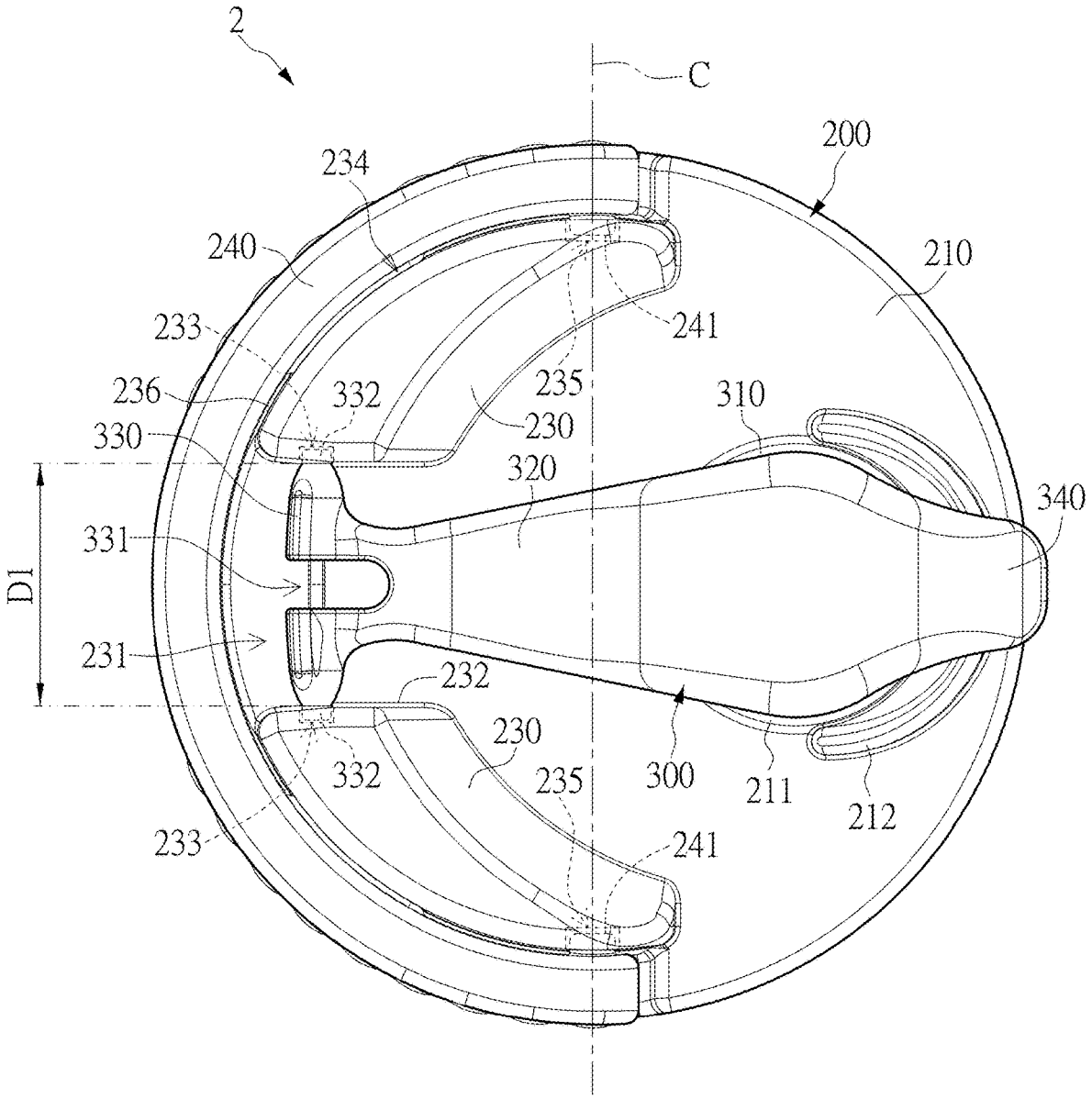
FIG. 4 is a schematic top view of the cover component according to the first embodiment of the present disclosure.

The pivot portion 230 is protrudingly disposed on the top surface of the top portion 210. As shown in FIG. 4, the pivot portion 230 is disposed at a side of the top portion 210 relative to the opening portion 211. The pivot portion 230 has a longitudinal slot 231 that is aligned with a center of the opening portion 211. A center of the longitudinal slot 231 is aligned with the opening portion 211. The longitudinal slot 231 has two slot side walls 232 that are parallel to each other, and a distance between the two slot side walls 232 is defined as a first distance D1. The two slot side walls 232 each has a first pivot hole 233 that corresponds to the other, so as to allow a pivotal connection with the second cover 300. In the present embodiment, the longitudinal slot 231 is located at a center of the pivot portion 230, so that the pivot portion 230 is formed into two protrusions that are parallel to each other as a result of being divided by the longitudinal slot 231. Two outer arc-shaped walls 234 are formed at a side of the pivot portion 230 relative to the opening portion 211, and a curved arc that is substantially formed along shapes of the outer arc-shaped walls 234 has a radius less than a radius of the outer periphery of the top portion 210. An end of each of the two outer arc-shaped walls 234 that faces toward the opening portion 211 extends over a center extension line C that passes through a center position of the top portion 210, and a second pivot hole 235 is formed at a position of each of the two outer arc-shaped walls 234 that corresponds to the center extension line C of the top portion 210, so as to allow a pivotal connection with a handle 240. Moreover, in the present embodiment, a second retaining groove 236 is disposed at each of the two outer arc-shaped walls 234 of the pivot portion 230, so as to be engaged with the handle 240.

A flange portion 212 is further disposed on the top surface of the top portion 210 of the first cover 200, and the flange portion 212 is located between an outer side of the opening portion 211 and the inner side of the outer periphery of the top portion 210. The flange portion 212 is an arc-shaped sheet having a diameter slightly greater than the diameter of the opening portion 211. From a cross-sectional view of the flange portion 212 (as shown in FIG. 7A and FIG. 8), an inclined surface is formed at one side of the flange portion 212 that faces toward the opening portion 211, and another side of the flange portion 212 relative to the opening portion 211 is approximately perpendicular to the top surface of the top portion 210, such that a cross-section of the flange portion 212 has a wedge shape (i.e., having a narrow upper part and a wide lower part). In addition, a first retaining groove 213 is disposed at another side of the flange portion 212 relative to the opening portion 211, so as to allow an engagement with the second cover 300. The flange portion 212 can be used to guide a water stream flown from the opening portion 211 into the mouth of the user (which is beneficial for the user when drinking water), and can also be used to facilitate positioning of the second cover 300.

The sleeve portion 220 is connected to the bottom surface of the top portion 210. A diameter of the sleeve portion 220 cooperates with an inner diameter of the opening end 130 of the beverage container 1. An outer side wall of the sleeve portion 220 has an outer threaded portion 221 that cooperates with the inner threaded portion 131, such that the sleeve portion 220 is threadedly engaged with the inner side of the opening end 130. Further, an upper end of the sleeve portion 230 is sleeved with a first sealing gasket 260. When the sleeve portion 220 is fixed with the inner side of the opening end 130 of the beverage container 1, the first sealing gasket 260 can be tightly fitted with the opening end 130. In this way, the first cover 200 is tightly fitted with the opening end 130 of the beverage container 1, so as to prevent beverages or drinking water from spilling out.

Figure 6:
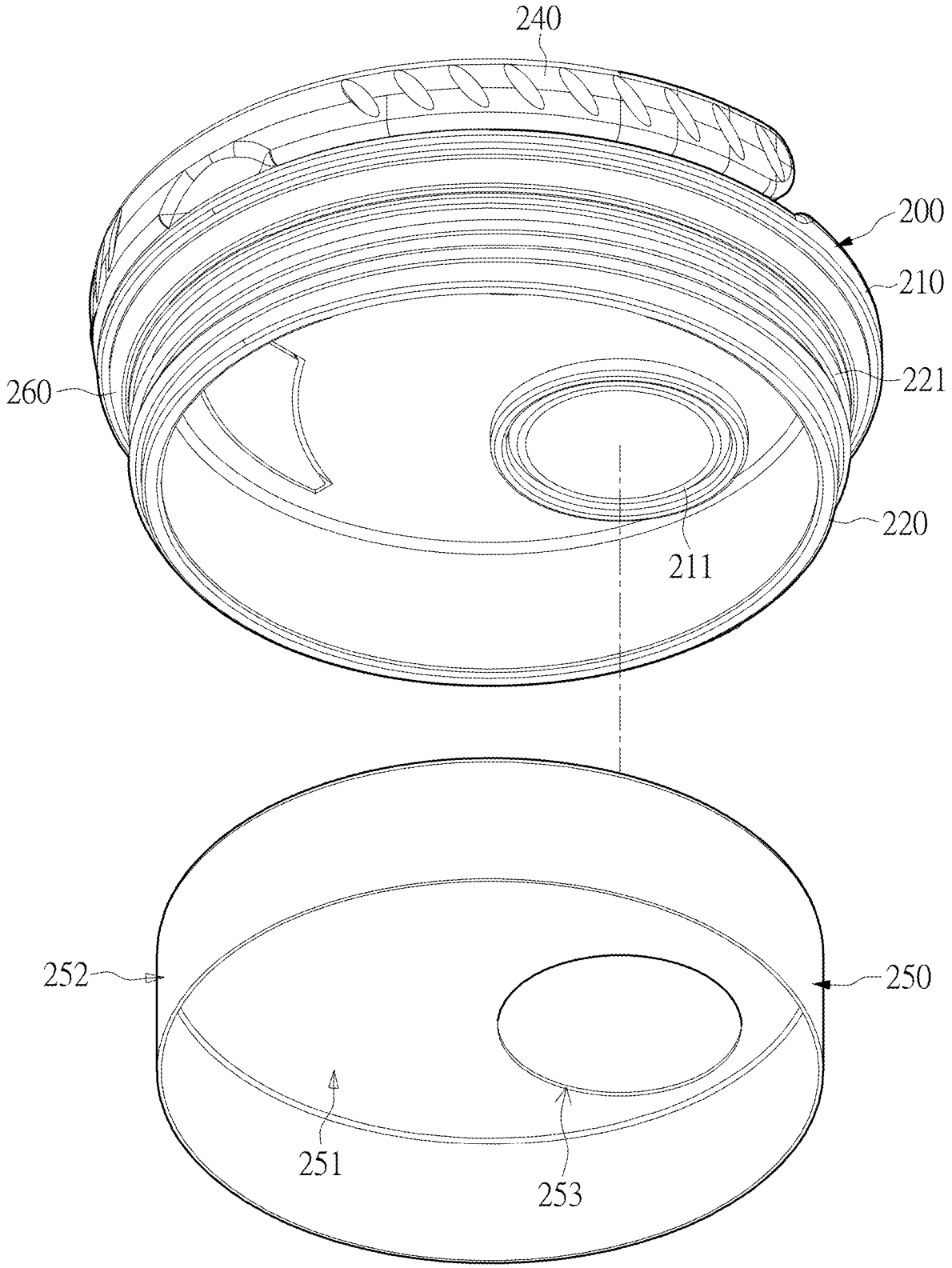
FIG. 6 is a schematic perspective view showing a first cover being separated from a metal inner liner according to the first embodiment of the present disclosure.

It should be noted that as shown in FIG. 6 to FIG. 8, an inner side of the sleeve portion 220 and the bottom surface of the top portion 210 jointly form a concave portion that is upwardly recessed in the present embodiment. A metal inner liner 250 is further disposed inside the concave portion. The metal inner liner 250 has a top wall 251 and a side wall 252, the top wall 251 has a shape that cooperates with the bottom surface of the top portion 210, the side wall 252 has a shape that cooperates with an inner side wall of the sleeve portion 220, and the top wall 251 has an opening 253 that corresponds in shape to the opening portion 211. The metal inner liner 250 can be bonded with the bottom surface of the top portion 210 and the concave portion at the inner side of the sleeve portion 220 by overmolding. The side wall 252 and the top wall 251 are attached to and shielded by the inner side wall of the sleeve portion 220 and the bottom surface of the top portion 210, respectively. In this way, an area of the first cover 200 that is in contact with beverages or drinking water is reduced.

Preferably, the metal inner liner 250 is made of a titanium metal plate. Since the titanium metal plate has characteristics of being non-toxic, erosion-resistant, anti-sticking and not prone to odor adsorption, chemical substances are not released into beverages or drinking water when the metal inner liner 250 is in contact with the beverages or the drinking water contained inside the beverage container 1. The metal inner liner 250 is not eroded when being in contact with acidic beverages, and the odor of the beverage is not adsorbed to the metal inner liner 250. Residue adhesion is also reduced. Accordingly, the hygiene of the drinking water can be improved, and pollution thereof can be prevented.

Figure 3:
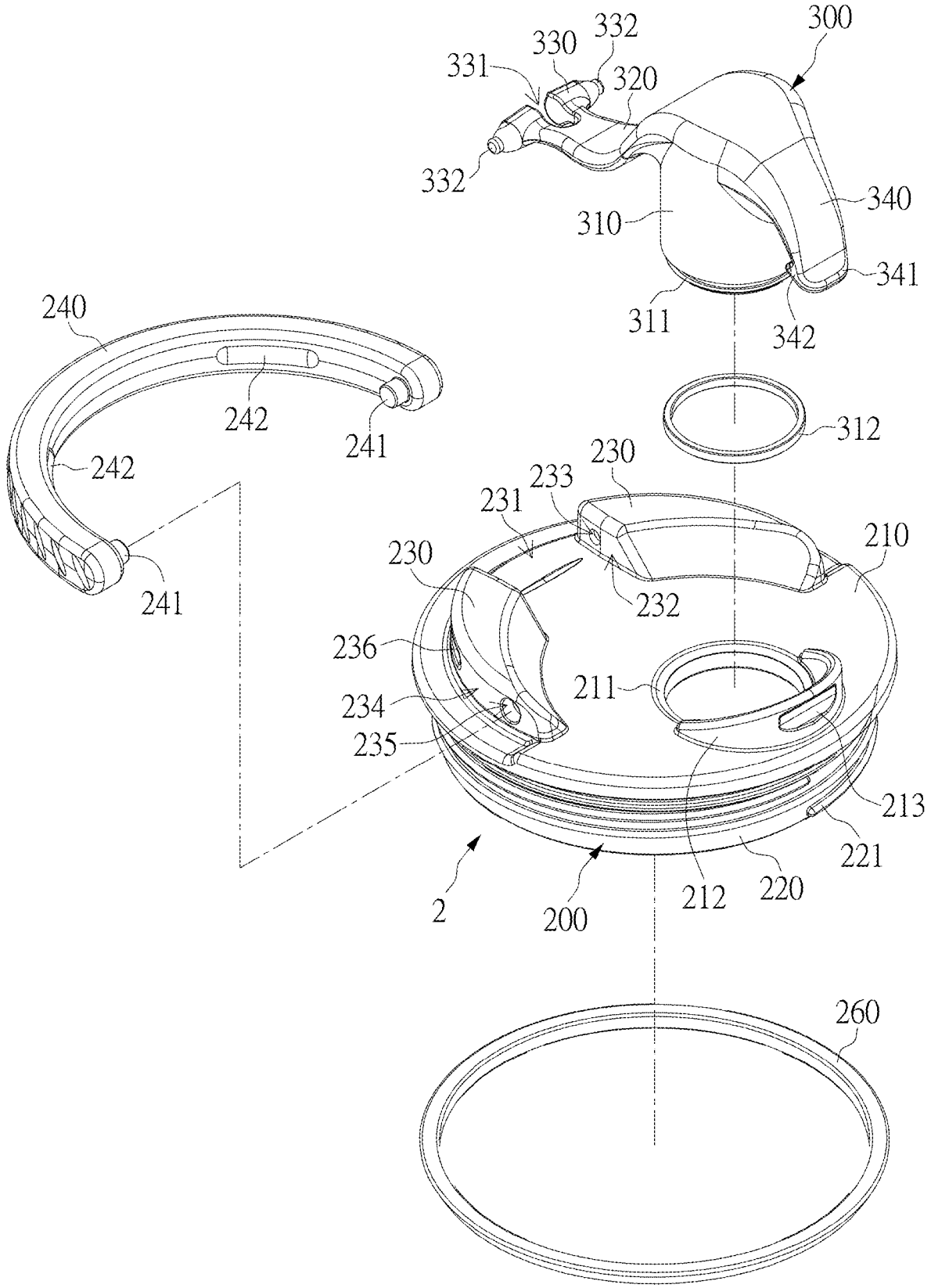
FIG. 3 is a perspective exploded view of a cover component according to the first embodiment of the present disclosure.
Figure 5:
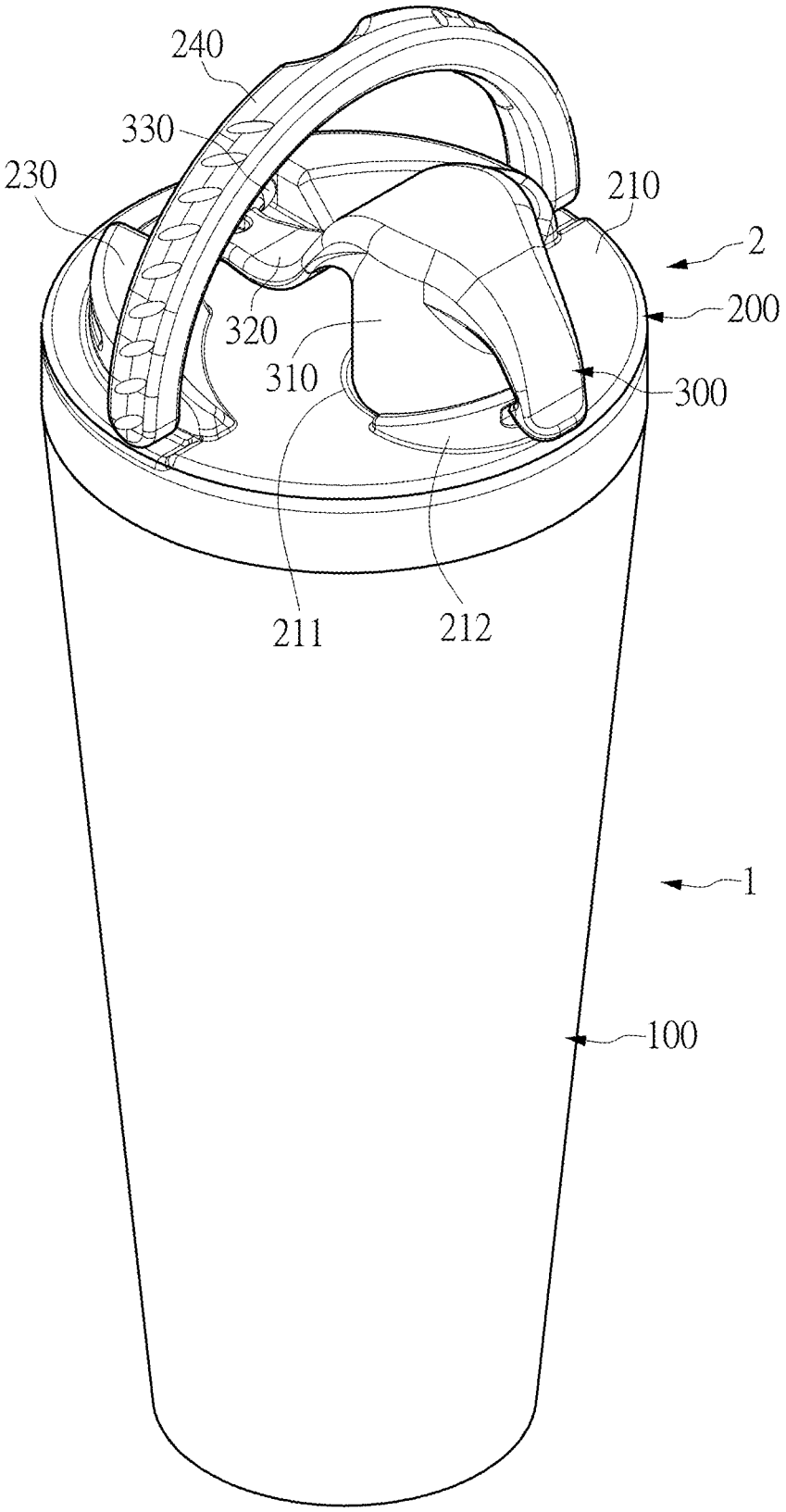
FIG. 5 is a schematic view showing a use state of the beverage container assembly when a handle of the cover component is in an upright position according to the first embodiment of the present disclosure.

As shown in FIG. 3 to FIG. 5, the handle 240 is connected to the pivot portion 230 by way of pivotal connection. In the present embodiment, the handle 240 is approximately arc-shaped, and has an inner side and an outer side that are opposite to each other. As shown in FIG. 4, contours of the inner side of the handle 240 cooperate with contours of the outer arc-shaped walls 234 of the pivot portion 230, contours of the outer side of the handle 240 cooperate with contours of the outer periphery of the top portion 210, and a thickness of the handle 240 cooperates with a height of the pivot portion 230 that protrudes from the top surface of the top portion 210. As such, when the handle 240 is folded to attach to the top surface of the top portion 210, the inner side of the handle 240 can be close to the outer arc-shaped walls 234 of the pivot portion 230, and an outer side edge and an upper side surface of the handle 240 can match the outer periphery of the top portion 210 of the first cover 200 and a top surface of the pivot portion 230. The outer side of the handle 240 does not protrude from an outer side of the outer periphery of the top portion 210, and a top surface of the handle 240 does not protrude from the top surface of the pivot portion 230.

As shown in FIG. 3, two second pivots 241 are respectively disposed at terminal ends of the inner side of the handle 240, and the two second pivots 241 protrude inwardly and correspond in position to the two second pivot holes 235. The two second pivots 241 can be fitted into the two second pivot holes 235, so that the handle 240 is pivotally connected to the pivot portion 230 of the first cover 200. Two second engaging portions 242 are disposed at the inner side of the handle 240, and the two second engaging portions 242 protrude inwardly and correspond in position to the two second retaining grooves 236. When the handle 240 is accommodated at the top surface of the first cover 200, the two second engaging portions 242 can be engaged with the two second retaining grooves 236, so that the handle 240 is positioned at the top surface of the first cover 200. As shown in FIG. 5, when the handle 240 is pulled up to be perpendicular to the first cover 200, the user can easily grasp the handle 240 and pick up the whole beverage container 1. Since the handle 240 is pivotally connected to the pivot portion 230 at a center position of the first cover 200, a position of the handle 240 matches a center of gravity of the beverage container 1. Hence, there is no tilting when the user uses the handle 240 to pick up the beverage container 1.

As shown in FIG. 3, FIG. 7A, and FIG. 8, the second cover 300 has a main body portion 310, a connecting arm 320, a pivot end 330 formed at a terminal end of the connecting arm 320, and an elastic engaging portion 340 formed at one side of the main body portion 310. In the present embodiment, the main body portion 310 is approximately in a columnar shape. A connection portion 311 is formed at a bottom end of the main body portion 310, and the connection portion 311 has a shape that cooperates with the opening portion 211 and can be tightly fitted with the opening portion 211. In addition, an outer side of the connection portion 211 is sleeved with a second sealing gasket 312.

As shown in FIG. 7A and FIG. 8, an inner side of the main body portion 310 has a straw accommodating portion 313 that is upwardly recessed from a bottom surface of the main body portion 310. The straw accommodating portion 313 is approximately in a columnar shape. A diameter of an inside of the straw accommodating portion 313 is configured to be greater than the outer diameter of the straw 3. Preferably, the diameter of the straw accommodating portion 313 is configured to be greater than 8 mm. When the second cover 300 covers the first cover 200, a height of an upper end of the straw accommodating portion 313 is greater than the top surface of the top portion 210, and the height of the straw accommodating portion 313 is configured to range between 5 mm and 50 mm. As shown in FIG. 7A, when the second cover 300 covers the top surface of the first cover 200, the connection portion 311 of the main body portion 310 is tightly fitted with the opening portion 211, and the straw accommodating portion 313 is located above the opening portion 211, so that the upper end of the straw 3 can be accommodated in the straw accommodating portion 313.

The connecting arm 320 is made of a plastic material having elasticity, and the connecting arm 320 is integrally connected to another side of the main body portion 310. The pivot end 330 is formed at an end of the connecting arm 320 relative to the main body portion 310, and the pivot end 330 is pivotally connected to the pivot portion 230, so that the second cover 300 can be pivotally connected to the first cover 200. More specifically, in the present embodiment, two first pivots 332 that protrude outward are respectively disposed at two sides of the pivot end 330, and an expansion joint 331 is formed at a center of the pivot end 330. The two first pivots 332 correspond in position and diameter to the two first pivot holes 233 of the pivot portion 230, and a distance between terminal ends of the two first pivots 332 is greater than the first distance D1, such that the two first pivots 332 are capable of being fitted into the two first pivot holes 233. In this way, the connecting arm 320 is pivotally connected to the pivot portion 230.

The expansion joint 331 is a groove positioned between the two first pivots 332, and the groove has an opening that faces toward a terminal end of the pivot end 330. Since the connecting arm 320 has elasticity, a width of the pivot end 330 located at the expansion joint 331 is deformably adjustable, thereby allowing a distance between the two first pivots 332 to be shortened (to the extent that the distance between the terminal ends of the two first pivots 332 is able to be shortened to be less than the first distance D1). Then, the two first pivots 332 are able to be easily fitted into or separated from the two first pivot holes 233. Through the above-mentioned configuration, the second cover 300 can be easily assembled to or detached from the first cover 200, such that the second cover 300 is replaceable.

As shown in FIG. 3, FIG. 7A, and FIG. 8, the elastic engaging portion 340 of the second cover 300 is disposed at a side of the main body portion 310 relative to the connecting arm 320. In the present embodiment, the elastic engaging portion 340 is integrally connected to an outer side wall of the main body portion 310, and a terminal end of the elastic engaging portion 340 faces outward and simultaneously extends downward to an outer side of the flange portion 212. A first engaging portion 342 that cooperates with the first retaining groove 213 is formed at an inner side of the elastic engaging portion 340. In addition, an actuating portion 341 is formed at a lower end of the elastic engaging portion 340, and the actuating portion 341 is positioned lower than the first engaging portion 342 and is outwardly inclined. As shown in FIG. 7A, when the second cover 300 covers the first cover 200, the elastic engaging portion 340 is positioned at the outer side of the flange portion 212 of the first cover 200, and the first engaging portion 342 can be engaged with the first retaining groove 213, such that the second cover 300 is positioned to cover the first cover 200. When the user intends to flip open the second cover 300, the user can hold the beverage container 1 by one hand and flick the actuating portion 341 in an upward direction with a finger of the same hand. Accordingly, the first engaging portion 342 is separated from the first retaining groove 213, and the second cover 300 can be conveniently moved upward. In this manner, the second cover 300 can be easily flipped open.

As shown in FIG. 7A and FIG. 8, when the cover component 2 is disposed on the beverage container 1, the straw 3 can be inserted into the beverage container 1 through the opening portion 211, and the upper end of the straw 3 can extend above the opening portion 211. Further, when the straw 3 is placed within the beverage container 1, and the second cover 300 covers the first cover 200, the upper end of the straw 3 can be accommodated in the straw accommodating portion 313. The upper end of the straw 3 and the second cover 200 do not structurally interfere with each other. Hence, without pulling out the straw 3, the user is able to cover the first cover 200 with the second cover 300. Since the straw 3 can be hidden within the beverage container 1, there is no need for separate storage. Therefore, any trouble caused by storing the straw 3 or any risk of polluting the straw 3 can be prevented.

As shown in FIG. 8, after the user flips open the second cover 300, the upper end of the straw 3 is directly exposed above the opening portion 211 of the first cover 200, and the user does not need to use the finger to pull out the straw 3 from an inner side of the opening portion 211. Accordingly, the user can directly use the mouth to bite the straw 3 and drink beverages or drinking water inside the beverage container 1. Throughout this process, the finger of the user does not need to be in contact with the straw 3, thereby reducing chances of the straw 3 being polluted. In addition, the finger can avoid the inconvenience of being made wet by the beverages or the drinking water on the straw 3.

It should be noted that in the present disclosure, the pivot end 330 of the connecting arm 320 of the second cover 300 is configured to be quickly assembled to or detached from the pivot portion 230. In this way, according to different requirements, manufacturers can use the first cover 200 of the same specification in cooperation with the second cover 300 of different specifications. For example, in one embodiment of the present disclosure, the straw 3 that is used with the beverage container assembly has different diameters, and the diameter of the straw accommodating portion 313 at the inner side of the main body portion 310 of the second cover 300 can also be changed according to the diameter of the straw 3. Therefore, the manufacturers provide multiple second covers 300 of which the straw accommodating portion 313 has different diameters. Different second covers 300 are selected in response to the diameter of the used straw 3, so as to allow the diameter of the straw accommodating portion 313 of the second cover 300 to cooperate with the straw 3.

When selling the beverage container assembly, the manufacturers or sellers can provide multiple straws 3 of different diameters for consumers to choose from. Further, according to the diameter of the straw 3 selected by the consumer, the second cover 300 of a corresponding specification can be used for customization purposes, or the straws 3 of different diameters can be arranged by the seller to cooperate with the second covers 300 of different specifications in each beverage container assembly. During use, the consumers are able to select the straw 3 of one diameter according to use requirements and replace the corresponding second cover 300 on their own, so as to provide a more convenient user experience.

Second Embodiment

Figure 9:
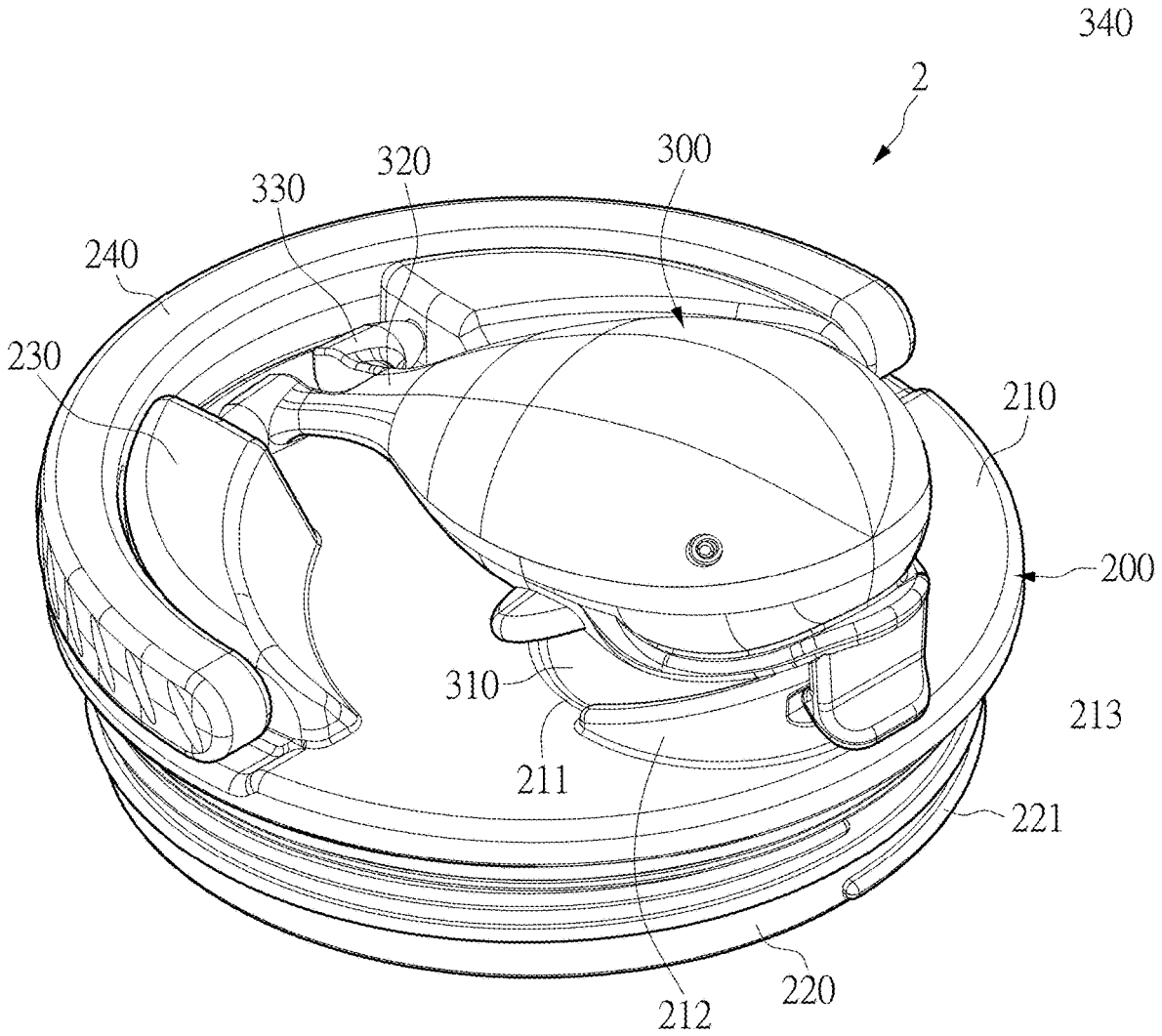
FIG. 9 is a perspective assembled view of the cover component according to a second embodiment of the present disclosure.
Figure 10:
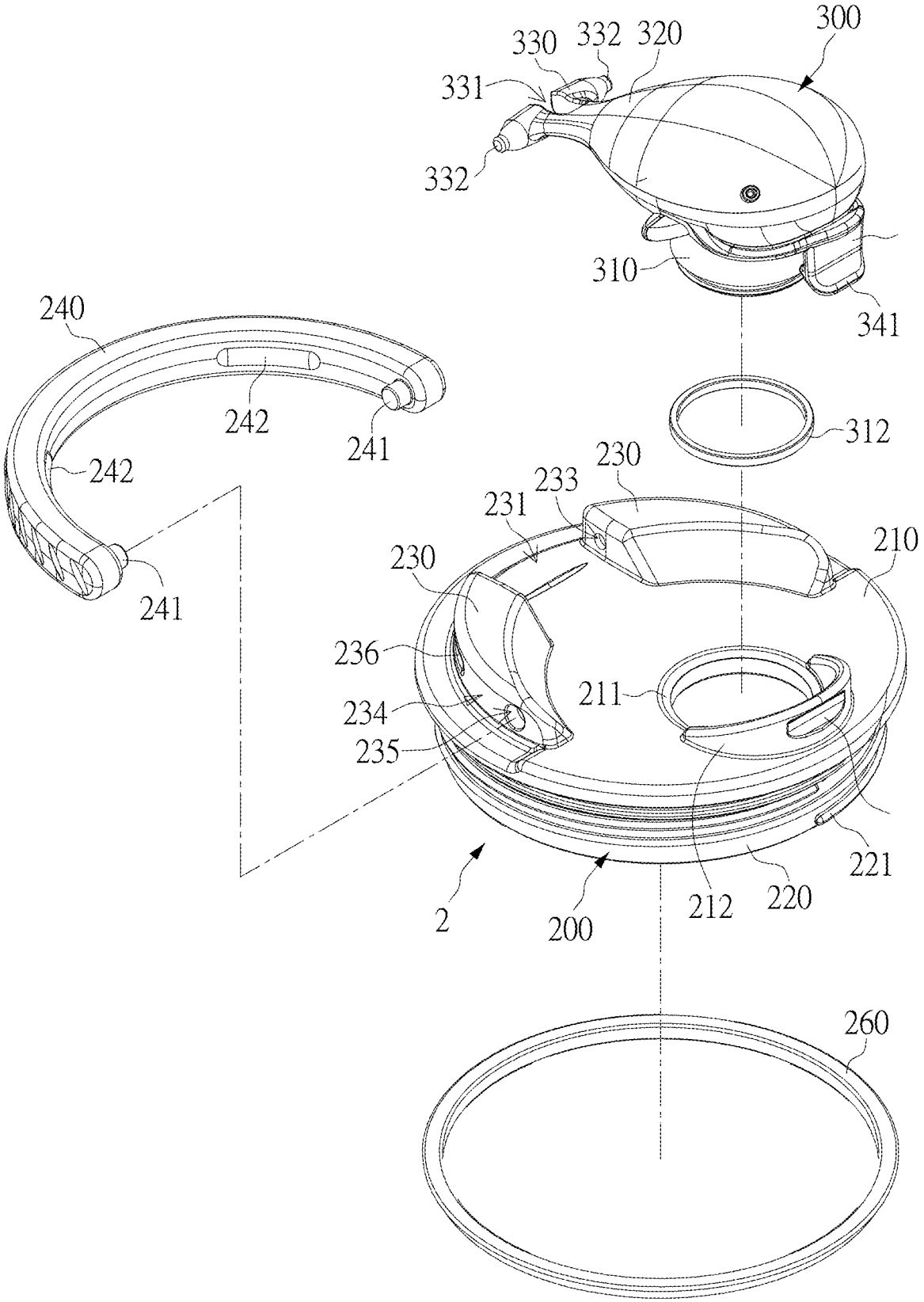
FIG. 10 is a perspective exploded view of the cover component according to the second embodiment of the present disclosure.
Figure 11:
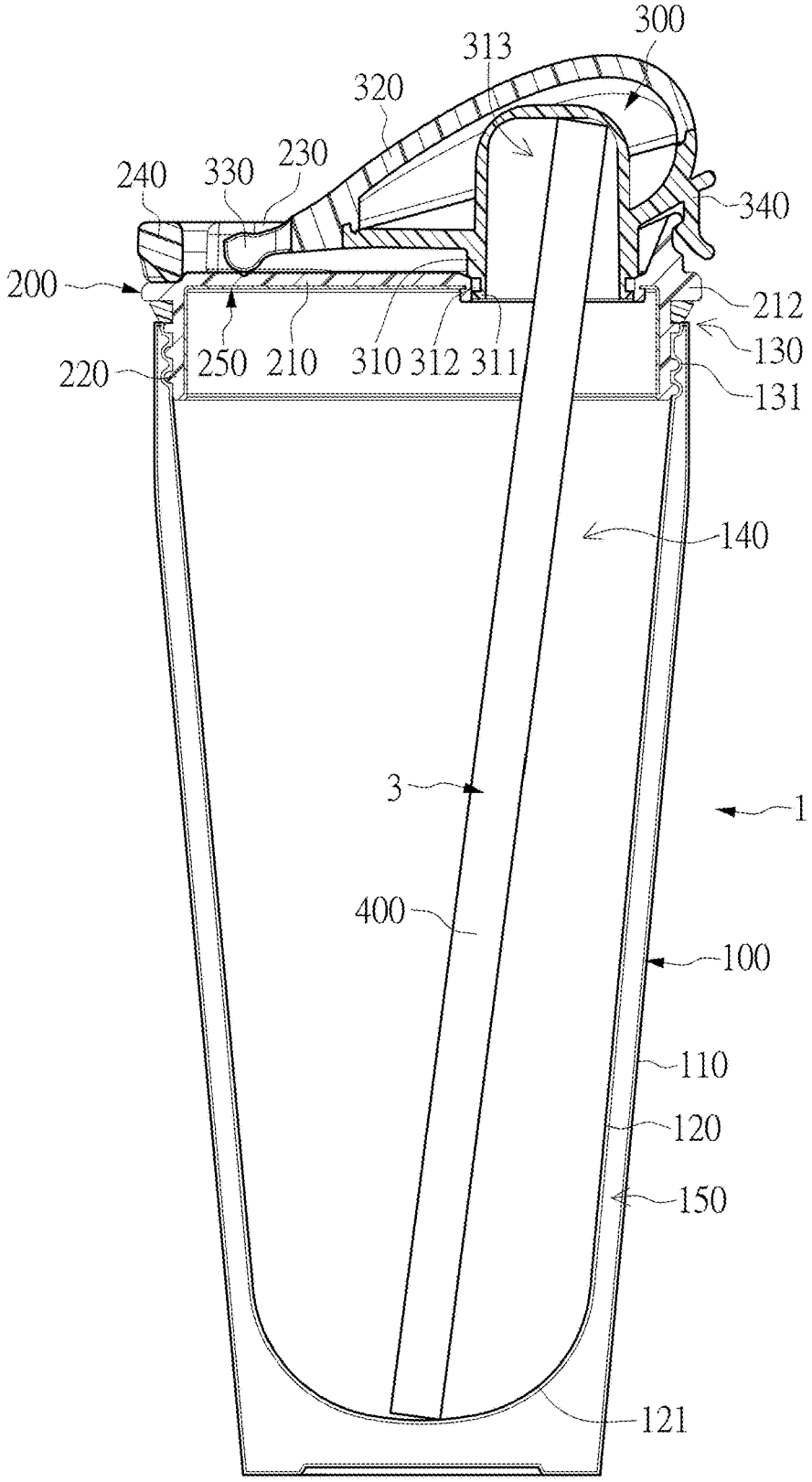
FIG. 11 is a schematic sectional view of the beverage container assembly when the second cover is in the covering state according to the second embodiment of the present disclosure.

Reference is made to FIG. 9 to FIG. 11, in which a cover component 2 of a second embodiment is shown. It should be noted that the basic structure of the cover component 2 of the present embodiment is similar to that of the first embodiment, and similarities therebetween will not be reiterated herein.

As shown in FIG. 9 to FIG. 11, a second cover 300 of the present embodiment is the same as that of the first embodiment, which also has a main body portion 310, a connecting arm 320 connected to one side of the main body portion 310, and a pivot end 330 formed at a terminal end of the connecting arm 320. A connection portion 311 that cooperates with an opening portion 211 is formed at a bottom of the main body portion 310, and a straw accommodating portion 313 is formed at a center of the main body portion 310. An elastic engaging portion 340 is further formed at an end of the main body portion 310 relative to the connecting arm 320. The pivot end 330 is formed at an end of the connecting arm 320 relative to the main body portion 310. Two first pivots 332 that correspond to two first pivot holes 233 are disposed at two sides of the pivot end 330, respectively. In addition, an expansion joint 331 is disposed between the two first pivots 332.

In the present embodiment, an outer appearance of the second cover 300 can be changed according to practical requirements. The manufacturers only need to configure the pivot end 330 of the connecting arm 320 of the second cover 300 that has different shapes to cooperate with a pivot portion 230 of a first cover 200, to configure the connection portion 311 of the main body portion 310 to cooperate with the opening portion 211 of the first cover 200, and to configure the elastic engaging portion 340 to cooperate with a flange portion 212 of the first cover 200, so that the second covers 300 of different shapes are interchangeable and can be assembled to the first cover 200. That is, the second cover 300 can properly cover the first cover 200.

Beneficial Effects of the Embodiments

In conclusion, in the beverage container assembly and the cover component thereof provided by the present disclosure, when the straw having a length greater than a height between the bottom portion of the accommodating space of the container body and the top surface of the first cover is used, the upper end of the straw can be directly exposed above the opening portion. In addition, without removal of the straw, the second cover can cover the first cover, and the upper end of the straw can be accommodated in the straw accommodating portion.

Furthermore, in the present disclosure, by virtue of the width of the pivot end disposed at the terminal end of the connecting arm of the second cover being changeable, the second cover can be easily assembled to or detached from the first cover. Accordingly, the second cover allows for easy assembly and replacement.

The foregoing description of the exemplary embodiments of the disclosure has been presented only for the purposes of illustration and description and is not intended to be exhaustive or to limit the disclosure to the precise forms disclosed. Many modifications and variations are possible in light of the above teaching.

The embodiments were chosen and described in order to explain the principles of the disclosure and their practical application so as to enable others skilled in the art to utilize the disclosure and various embodiments and with various modifications as are suited to the particular use contemplated. Alternative embodiments will become apparent to those skilled in the art to which the present disclosure pertains without departing from its spirit and scope.

What is claimed is:

1. A beverage container assembly, comprising:

a beverage container, wherein the beverage container has a container body, an accommodating space is formed inside the container body, an upper end of the container body has an opening end, and an inner side of the opening end has an inner threaded portion;

a straw, wherein the straw is capable of being received in the accommodating space of the container body; and a cover component disposed at the upper end of the beverage container, wherein the cover component includes:

a first cover having a top portion and a sleeve portion that is linkable with the opening end, wherein the top portion has a circular shape, the top portion defines a top surface and a bottom surface, the top portion includes an opening portion and a pivot portion that is protrudingly disposed on the top surface of the top portion, and the opening portion is a round hole that is disposed near an inner side of an outer periphery of the top portion; wherein the sleeve portion is connected to the bottom surface of the top portion, and an outer side wall of the sleeve portion has an outer threaded portion that cooperates with the inner threaded portion; and a second cover having a main body portion and a connecting arm that is connected to the main body portion, wherein a bottom end of the main body portion has a sealed portion that cooperates with the opening portion, an inner side of the main body portion has a straw accommodating portion that is upwardly recessed from a bottom surface of the main body portion, and a pivot end that is pivotally connected to the pivot portion is formed at an end of the connecting arm relative to the main body portion;

wherein the pivot portion is disposed at a side of the top portion relative to the opening portion, a center of the pivot portion has a longitudinal slot, a center of the longitudinal slot is aligned with a center of the opening portion, the longitudinal slot has two slot side walls that are parallel to each other, a distance between the two slot side walls is defined as a first distance, and the two slot side walls each has a first pivot hole that corresponds to the other;

wherein two first pivots that protrude outward are respectively disposed at two sides of the pivot end of the connecting arm, and an expansion joint is formed at a center of the pivot end; wherein the two first pivots correspond in position and diameter to the two first pivot holes, and a distance between terminal ends of the two first pivots is greater than the first distance, such that the two first pivots are capable of being fitted into the two first pivot holes; wherein the expansion joint is a groove positioned between the two first pivots, and the groove has an opening that faces toward a terminal end of the pivot end;

wherein an inner side of the sleeve portion and the bottom surface of the top portion jointly form a concave portion that is upwardly recessed; wherein a metal inner liner is disposed inside the concave portion, the metal inner liner has a top wall and a side wall, the top wall has a shape that cooperates with the bottom surface of the top portion, the side wall has a shape that cooperates with an inner side wall of the sleeve portion, and the top wall has an opening that corresponds in shape to the opening portion.

2. The beverage container assembly according to claim 1, wherein a diameter of the straw accommodating portion is configured to be greater than 8 mm, and a height of the straw accommodating portion is configured to range between 5 mm and 50 mm.

3. The beverage container assembly according to claim 1, wherein a flange portion is disposed on the top surface of the top portion of the first cover, the flange portion is located between an outer side of the opening portion and the inner side of the outer periphery of the top portion, and a first retaining groove is disposed at a side surface of the flange portion relative to the opening portion; wherein an elastic engaging portion is disposed at a side of the main body portion relative to the connecting arm, a terminal end of the elastic engaging portion faces outward and extends downward to an outer side of the flange portion, a first engaging portion that cooperates with the first retaining groove is formed at an inner side of the elastic engaging portion, an actuating portion is formed at a lower end of the elastic engaging portion, and the actuating portion is positioned lower than the first engaging portion and is outwardly inclined.

4. The beverage container assembly according to claim 1, wherein the longitudinal slot is located at the center of the pivot portion, so that the pivot portion is formed into two protrusions that are parallel to each other; wherein two outer arc-shaped walls are formed at a side of the pivot portion relative to the opening portion, a curved arc that is formed along shapes of the two outer arc-shaped walls has a radius less than a radius of the outer periphery of the top portion, an end of each of the two outer arc-shaped walls that faces toward the opening portion extends over a center of the top portion, and a second pivot hole is formed at a position of each of the two outer arc-shaped walls that corresponds to the center of the top portion; wherein the first cover further includes a handle, and the handle has an inner side and an outer side that are opposite to each other; wherein two second pivots are respectively disposed at two ends of the inner side of the handle, and the two second pivots protrude inwardly and correspond to the two second pivot holes, so that the handle is pivotally connected to the pivot portion; wherein contours of the inner side of the handle cooperate with contours of the outer arc-shaped walls of the pivot portion, contours of the outer side of the handle cooperate with contours of the outer periphery of the top portion, and a thickness of the handle cooperates with a height of the pivot portion that protrudes from the top surface of the top portion; wherein a second retaining groove is disposed at each of the two outer arc-shaped walls, and two second engaging portions that correspond to the two second retaining grooves are disposed at the inner side of the handle; wherein the handle is configured to swing around the two second pivots, and the two second engaging portions are engaged with the two second retaining grooves when the handle is swung to be attached to the top surface of the top portion.

5. The beverage container assembly according to claim 1, wherein the container body has an outer cup body and an inner cup body that are spaced apart from each other, a thermal insulation interlayer is formed between the outer cup body and the inner cup body, and the outer cup body and the inner cup body are made of titanium metal plates; wherein an inner cup bottom portion is formed at a bottom of the inner cup body, and the inner cup bottom portion is downwardly recessed at a center position thereof.

6. The beverage container assembly according to claim 5, wherein the inner cup bottom portion is formed by connecting a plurality of arc-shaped portions that have different radii of curvature, or has a non-spherical concave shape formed by a freeform surface with continuously changing radii of curvature.

7. The beverage container assembly according to claim 6, wherein the radii of curvature of the inner cup bottom portion are arranged to gradually increase from a position near an outer side of the inner cup bottom portion to the center position of the inner cup bottom portion, so that half a width of the inner cup bottom portion is greater than a depth of the inner cup bottom portion.

8. The beverage container assembly according to claim 5, wherein an inner side surface of the inner cup body has an inner oxide layer, and an outer side surface of the outer cup body has an outer protective layer.

9. The beverage container assembly according to claim 8, wherein the inner oxide layer is a titanium oxide thin film in a rutile crystal form that is formed on the inner side surface of the inner cup body through a thermal oxidation process; wherein the outer protective layer is a titanium oxide, titanium nitride, or titanium oxynitride thin film that is formed on the outer side surface of the outer cup body through the thermal oxidation process, an electrochemical process, or a micro-arc oxidation process.

10. A cover component for disposing at an opening end of a beverage container, and the opening end has an inner threaded portion, the cover component comprising:

a first cover having a top portion and a sleeve portion that is linkable with the opening end, wherein the top portion has a circular shape, the top portion defines a top surface and a bottom surface, the top portion includes an opening portion and a pivot portion that is protrudingly disposed on the top surface of the top portion, and the opening portion is a round hole that is disposed near an inner side of an outer periphery of the top portion; wherein the sleeve portion is connected to the bottom surface of the top portion, and an outer side wall of the sleeve portion has an outer threaded portion that cooperates with the inner threaded portion; and a second cover having a main body portion and a connecting arm that is connected to the main body portion, wherein a bottom end of the main body portion has a sealed portion that cooperates with the opening portion, an inner side of the main body portion has a straw accommodating portion that is upwardly recessed from a bottom surface of the main body portion, and a pivot end that is pivotally connected to the pivot portion is formed at an end of the connecting arm relative to the main body portion;

wherein the pivot portion is disposed at a side of the top portion relative to the opening portion, a center of the pivot portion has a longitudinal slot, a center of the longitudinal slot is aligned with a center of the opening portion, the longitudinal slot has two slot side walls that are parallel to each other, a distance between the two slot side walls is defined as a first distance, and the two slot side walls each has a first pivot hole that corresponds to the other;

wherein two first pivots that protrude outward are respectively disposed at two sides of the pivot end of the connecting arm, and an expansion joint is formed at a center of the pivot end; wherein the two first pivots correspond in position and diameter to the two first pivot holes, and a distance between terminal ends of the two first pivots is greater than the first distance, such that the two first pivots are capable of being fitted into the two first pivot holes; wherein the expansion joint is a groove positioned between the two first pivots, and the groove has an opening that faces toward a terminal end of the pivot end;

wherein an inner side of the sleeve portion and the bottom surface of the top portion jointly form a concave portion that is upwardly recessed; wherein a metal inner liner is disposed inside the concave portion, the metal inner liner has a top wall and a side wall, the top wall has a shape that cooperates with the bottom surface of the top portion, the side wall has a shape that cooperates with an inner side wall of the sleeve portion, and the top wall has an opening that corresponds in shape to the opening portion.

11. The cover component according to claim 10, wherein a flange portion is disposed on the top surface of the top portion of the first cover, the flange portion is located between an outer side of the opening portion and the inner side of the outer periphery of the top portion, and a first retaining groove is disposed at a side surface of the flange portion relative to the opening portion; wherein an elastic engaging portion is disposed at a side of the main body portion relative to the connecting arm, a terminal end of the elastic engaging portion faces outward and extends downward to an outer side of the flange portion, a first engaging portion that cooperates with the first retaining groove is formed at an inner side of the elastic engaging portion, an actuating portion is formed at a lower end of the elastic engaging portion, and the actuating portion is positioned lower than the first engaging portion and is outwardly inclined.

12. The cover component according to claim 10, wherein the longitudinal slot is located at the center of the pivot portion, so that the pivot portion is formed into two protrusions that are parallel to each other; wherein two outer arc-shaped walls are formed at a side of the pivot portion relative to the opening portion, a curved arc that is formed along shapes of the two outer arc-shaped walls has a radius less than a radius of the outer periphery of the top portion, an end of each of the two outer arc-shaped walls that faces toward the opening portion extends over a center of the top portion, and a second pivot hole is formed at a position of each of the two outer arc-shaped walls that corresponds to the center of the top portion; wherein the first cover further includes a handle, and the handle has an inner side and an outer side that are opposite to each other; wherein two second pivots are respectively disposed at two ends of the inner side of the handle, and the two second pivots protrude inwardly and correspond to the two second pivot holes, so that the handle is pivotally connected to the pivot portion; wherein contours of the inner side of the handle cooperate with contours of the outer arc-shaped walls of the pivot portion, contours of the outer side of the handle cooperate with contours of the outer periphery of the top portion, and a thickness of the handle cooperates with a height of the pivot portion that protrudes from the top surface of the top portion; wherein a second retaining groove is disposed at each of the two outer arc-shaped walls, and two second engaging portions that correspond to the two second retaining grooves are disposed at the inner side of the handle; wherein the handle is configured to swing around the two second pivots, and the two second engaging portions are engaged with the two second retaining grooves when the handle is swung to be attached to the top surface of the top portion.

* * * * *